US005881867A

United States Patent [19]

Tohill, Jr. et al.

[11] Patent Number: 5,881,867

[45] Date of Patent: Mar. 16, 1999

[54] CONTACT LENS STORAGE CONTAINER

[76] Inventors: Gaylord Ewing Tohill, Jr., 1887 Teakwood Way; Steve Edward Henschel, 920 Alta Vista Dr., both of Vista, Calif. 92083

[21] Appl. No.: 658,719

[22] Filed: Jun. 5, 1996

[51] Int. Cl.[6] ..... A45C 11/04

[52] U.S. Cl. ..... 206/5.1; 206/316.1; 206/459.5; 224/148.7

[58] Field of Search ..... 206/5.1, 570, 316.1, 206/581, 459.5; 224/148.7, 666, 669, 679, 682; 132/316

[56] References Cited

U.S. PATENT DOCUMENTS

| | | | |
|---|---|---|---|
| 2,573,620 | 10/1951 | Spitalny | 132/316 |
| 3,768,633 | 10/1973 | Nathan | 206/5.1 |
| 4,044,933 | 8/1977 | Artz | 224/666 |
| 4,925,017 | 5/1990 | Jessen | 206/5.1 |
| 4,951,817 | 8/1990 | Barletta et al. | 224/679 |
| 5,007,531 | 4/1991 | Lighten | 206/581 |
| 5,224,593 | 7/1993 | Bennett | 206/5.1 |
| 5,337,890 | 8/1994 | Lai | 132/316 |
| 5,379,884 | 1/1995 | Bigott | 224/666 |
| 5,433,314 | 7/1995 | Lin | 206/5.1 |

*Primary Examiner*—Paul T. Sewell
*Assistant Examiner*—Nhan T. Lam
*Attorney, Agent, or Firm*—Patent & Trademark Services; Thomas Zack; Joseph H. McGlynn

[57] ABSTRACT

A small easily carried contact lens storage container having a hinged top cover for its main storage compartment. Within this main compartment a mirror, two contact lens storage compartments and two bottles with lens care fluids may be stored. The bottles' tops may be color coded to indicate the particular fluids therein. Exterior of the main compartment are additional two screw-on lens compartments. A clip on the container allows attachment to a user's clothing much like a phone pager.

5 Claims, 1 Drawing Sheet

CONTACT LENS STORAGE CONTAINER

BACKGROUND OF THE INVENTION

The present invention relates to a storage container for contact lenses and related lens care products. Stored within a single container are: two contact lenses, two extra lenses, two refillable bottles for lens disinfectant and cleaner and a mirror. This small container is a convenient size that is easily accessed with a user attachment clip.

DESCRIPTION OF THE PRIOR ART

In the prior art various types of containers for contact lenses are disclosed. One example is U.S. Pat. No. 5,016,749 to Kaye et al. wherein one container can carry both spectacles and contact lenses.

Other containers (e.g., U.S. Pat. No. 5,280,834 to Berkley) having changeable dates displayed in digital format.

With some containers related lens care products, such as in U.S. Pat. No. 4,909,382 to Cuppari and U.S. Pat. No. 5,375,699 to Amend, include a mirror as well as the lenses in a fluid. A timer for timing the disinfecting and rinsing cycles may also be included as in the cited Cuppari reference.

However, none of the known prior art discloses a single contact lens container which will conveniently store not only the contact lenses, but two substitute lenses, two fluid treatment bottles, and a mirror. The container also has a clip on feature and a hinged cover with the mirror on its opposite side.

SUMMARY OF THE INVENTION

The present invention consists of a contact lens container having a main storage compartment and two contact lens storage compartments. Stored within the main compartment are: two replacement lens storage areas, a mirror and two lens care bottles. This main compartment has a hinged opening top with the mirror on its opposite facing surface. The lenses currently used are stored in two screw on lid compartments exterior attached to main compartment. The lens care bottles may be color coded and a clip-on attachment is provided to attach the container to a user's clothing, such as belt or pant, as would a pager unit.

It is an object of the present invention to provide an improved carrying container for contact lens and related lens care products.

It is a further object of the present invention to provide such a container wherein there is a main storage compartment with two small compartments for the lenses in current use.

It is another object of the present invention to provide a small inexpensive contact lens container which can be attached to a user.

These and other objects and advantages of the present invention will be fully apparent from the following description, when taken in connection with the annexed drawings.

DESCRIPTION OF THE PREFERRED EMBODIMENT

Figure 1:
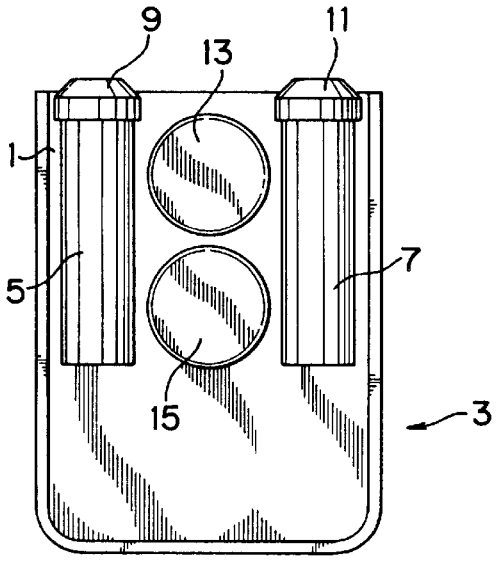
FIG. 1 is a cut away front view of the present invention showing the main compartment and the articles therein.

Referring now to the drawings in greater detail, FIG. 1 shows a cut away view of the main body compartment 1 of the container 3. Within this compartment are two substantially identical plastic bottles 5 and 7 (shown partially removed from the container) having color coded screw-on cap tops 9 and 11, respectively. One color can be used to designate that the solution is for eye rewetting drops and the other color that the solution is for a daily cleaner or storage solution. Also shown are two separate substantially identical lens storage containers 13 and 15. These containers can be used for replacement contact lenses.

Figure 2:
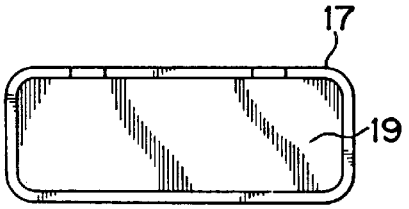
FIG. 2 is a top view of the present invention illustrating the hinged top in an opened position.
Figure 3:
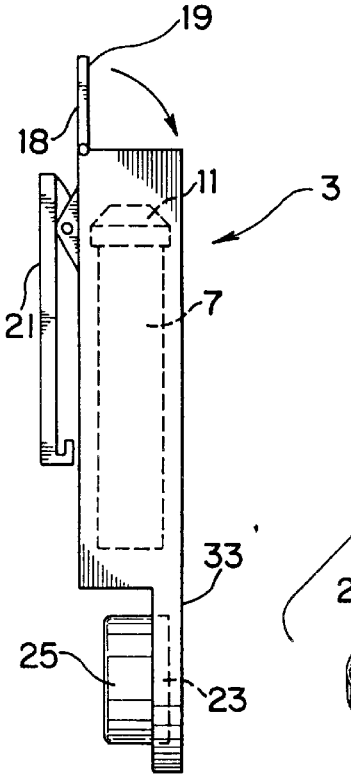
FIG. 3 is a side view of the main container compartment with its top cover in an opened position.

FIG. 2 is a top view of the container showing its hinged 17 top cover 18 in an opened position to reveal attached the mirror 19. Were the top surface closed by moving it in the direction of the arrow (see FIG. 3), the mirror normally would face downward and be out of sight. The FIG. 3 side view also has the top cover opened. Shown in dotted line format is one (7) of the two stored identical main body compartment stored plastic bottles with its cap 11, the mirror 19 on hinged top 18 and the clip 21 joined to the container near the top cover's hinge 17. Also shown in this figure is a sectional view of one(23) of two other exterior lens holder compartments with its screw-on cover cap 25 in place.

Figure 4:
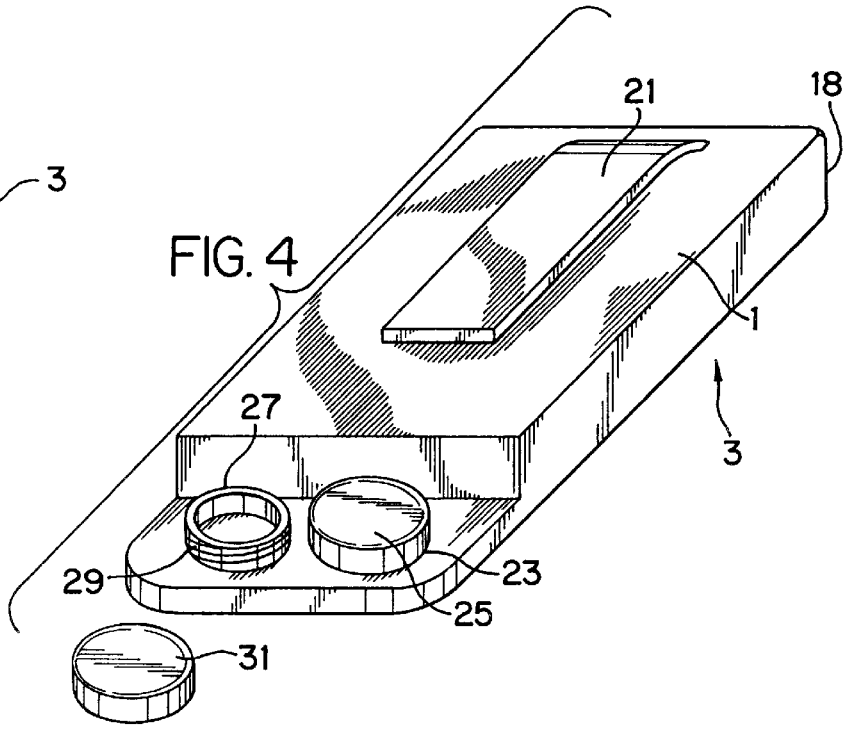
FIG. 4 depicts the complete container with its top cover closed and one of the two lens compartments opened.

FIG. 4 illustrates the container 3 with its top cover 18 in a closed position. The lens compartment 23 is located exterior of the main body container compartment and has its cover 25 in a screwed-on closed position. The other exterior lens compartment 27, shown in an opened state, reveals its screw threads 29 which engage complementary internal (not shown) threads on the screw-on cap 31. Normally these two exterior lens compartments are used to store the contact lenses currently being used. Each may have a daily storage solution in their respective compartments.

The overall dimensions of container 3 are slightly over 2 inches (2.0011) in height including the portion 33 which extends to support the two exterior lens compartments 23 and 27, 0.8401 inches in depth by about 2.240 inches in width. Most of the components can be made of a light weight plastic material including the main body compartment with its top and extension, the four lens compartments, the two bottles, the lens compartment caps and the clip. Thus, we have invented a compact easily carried container capable of storing all needed for a user materials including two sets of contact lens, two bottles, and a mirror. Clearly, the dimensions, shape and materials used to construct the preferred embodiment can vary.

Although the CONTACT LENS STORAGE CONTAINER and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A contact lens storage compartment comprising:

a main storage body compartment having a hinged top cover;

at least one contact lens storage compartment adapted to be placed in said main storage compartment;

at least one bottle containing a lens care fluid adapted to be stored in said main storage compartment;

a mirrored surface adapted to be in said main compartment near the hinged top cover; and at least one additional lens storage compartment exterior to said main storage compartment.

2. The invention as claimed in claim 1, wherein there are two exterior lens compartments each with its own screw-on lids.

3. The invention as claimed in claim 2, wherein there are two bottles containing a lens care fluid, each of said bottles having a different color coded top indicating the particular fluid therein.

4. The invention as claimed in claim 3, also including a clip attached to the container's exterior near where the top cover is hinged.

5. The invention as claimed in claim 4, wherein said mirror is located on the interior side of the top cover.

* * * * *